United States Patent [19]

Boyer et al.

[11] 4,134,450

[45] Jan. 16, 1979

[54] SURFACE CONDENSER WITH VERTICALLY SEPARATED TUBE BUNDLES

[75] Inventors: Robert C. Boyer; John A. Martin, both of Easton; LeRoy J. Raseley, Saylorsburg, all of Pa.; Robert J. Stoker, Phillipsburg, N.J.

[73] Assignee: Ecolaire Incorporated, Malvern, Pa.

[21] Appl. No.: 671,838

[22] Filed: Mar. 30, 1976

[51] Int. Cl.[2] ..... F28F 9/04

[52] U.S. Cl. ..... 165/111; 165/101; 165/145

[58] Field of Search ..... 60/690, 692, 693; 165/111–114, 143, 144, 145, 101, 103

[56] References Cited

U.S. PATENT DOCUMENTS

| | | | |
|---|---|---|---|
| 1,222,801 | 4/1917 | Rosenbaum | 165/111 X |
| 1,407,137 | 2/1922 | Ehrhart | 165/114 |
| 1,502,256 | 7/1924 | Lonsdale | 165/114 |
| 1,502,257 | 7/1924 | Lonsdale | 165/114 |
| 2,167,028 | 7/1939 | McGovern | 165/112 X |
| 2,869,833 | 1/1959 | Aronson et al. | 165/114 |
| 2,939,685 | 6/1960 | Worn et al. | 165/114 |
| 3,529,662 | 9/1970 | Roe | 165/111 |
| 3,693,708 | 9/1972 | Andoniev et al. | 165/101 |
| 3,698,476 | 10/1972 | Wyzalek et al. | 165/112 |
| 3,703,809 | 11/1972 | Cassidy | 60/692 X |
| 3,827,479 | 8/1974 | Fejes | 165/101 |
| 4,016,927 | 4/1977 | Palmer | 60/692 |

FOREIGN PATENT DOCUMENTS

| | | | |
|---|---|---|---|
| 532875 | 8/1931 | Fed. Rep. of Germany | 165/113 |
| 249905 | 4/1926 | United Kingdom | 165/114 |
| 835419 | 5/1960 | United Kingdom | 60/693 |

*Primary Examiner*—Charles J. Myhre
*Assistant Examiner*—Sheldon Richter
*Attorney, Agent, or Firm*—Seidel, Gonda & Goldhammer

[57] ABSTRACT

The system for condensing gases such as steam includes a housing with a gas inlet. At least one vertical column of vertically spaced separate tube bundles are in the housing. A separate water conduit is connected to the inlet of each of the separate tube bundles.

5 Claims, 4 Drawing Figures

SURFACE CONDENSER WITH VERTICALLY SEPARATED TUBE BUNDLES

This invention relates to surface condensers. More particularly, ths invention is an improved surface condenser system with a plurality of separated tube bundles located in a housing.

In a surface condenser such as surface condensers for condensing steam by flowing cold water through tube bundles which are contacted by the steam and thus condensed, contamination often gets into the condensing system. This contamination may occur by leakage from the tubes. Usually, the contamination occurs near the tube sheets although contamination may occur anywhere in the system.

In many currently used surface condensers, when contamination occurs, the tubes are plugged and repairs made. The operation of the condenser must be completely shut down or a major part of the condensing system shut down. This invention is a steam condenser which includes as a part of the condensing system a plurality of vertically separated tube bundles. Means are provided for detecting contamination from each individual tube bundle. If contamination occurs in one tube bundle, that tube bundle can be shut off and repaired without interfering with the operation of the remaining tube bundles. Thus substantial operation of the surface condenser is maintained even though contamination has occured in one of the tube bundles.

A surface condenser for condensing steam is constructed to produce a predetermined operating pressure (usually vacuum or a low absolute pressure) at the turbine exhaust flange with a given quantity and temperature of circulating water. Power demands from a given generating unit can vary on an hourly basis. With low power demands, the quantity of steam flowing through the turbine and the condenser can be lessened. Thus, at a reduced power demand and steam flow, the quantity of circulating water flowing and the number of circulating pumps, and number of tube bundles which are operational, can be reduced. With this invention under such circumstances proportionally selected tube bundles can be removed from operation, and yet a desirable and acceptable turbine back pressure can be maintained.

The steam entering the steam inlet of the condenser housing from the low pressure exhaust of a steam turbine often has flow velocities that approach or achieve sonic velocities. A single pass surface condenser demands more steam at the circulating water inlet end of the tubes where the water is cold than at the circulating water outlet end of the tubes where the water is warmer. Thus with conventional condensers, a demand for longitudinal flow exists. A steam dome is provided between the turbine exhaust flange and the top of the tube bundles with intent to provide this flow distribution with a minimum loss in pressure. In most cases, due to the extremely high steam velocities and short turning distances, and the clutter of necessary hardware contained within this dome, this longitudinal distribution cannot be obtained without substantial pressure drop. The structure and configuration of tube bundles in our condenser provides a substantial area below the top of the tube bundles to permit a more orderly longitudinal flow with less pressure drop.

Accumulations of condensate on individual tubes reduce the coefficient of heat transfer between the colder circulating water and the hotter steam, thus impairing condensing capacity. Tube bundle structures which permit such accumulations are undesirable. Such a condition will exist when tube bundles without suitable collecting methods are provided. This condition will occur in tube bundles which are relatively deep. This invention having a multitude of tube bundles contains a collecting tray as part of each bundle above the lowermost tube bundle to channel the condensate into areas void of tubes, to prevent excessive accumulation of condensate on the lower part of the tube bundles.

Briefly described, this system for condensing a gas comprises a housing with a gas inlet which is typically at the top of the housing. At least one vertical column and preferably two vertical columns of vertically spaced separate tube bundles are provided in the housing. More than two vertical columns may be used, if desired. A separate water conduit is connected to each of the separate tube bundles for feeding water through the tubes in the tube bundles. Also, a separate water conduit is connected at the exit or outlet of each of the separate tube bundles. If desired, a plurality of separate housings, each containing tube bundles may be connected in series.

This construction provides a distinct advantage over other current surface condensers insofar as versatility is concerned. For example, a six tube bundle structure would allow approximately one-sixth of the condenser surface to be shut down while maintaining nearly a full load operation.

The invention, as well as its many advantages, may be further understood by the following detailed description and drawings in which.

In the various figures, like parts are referred to by like numbers.

Figure 1:
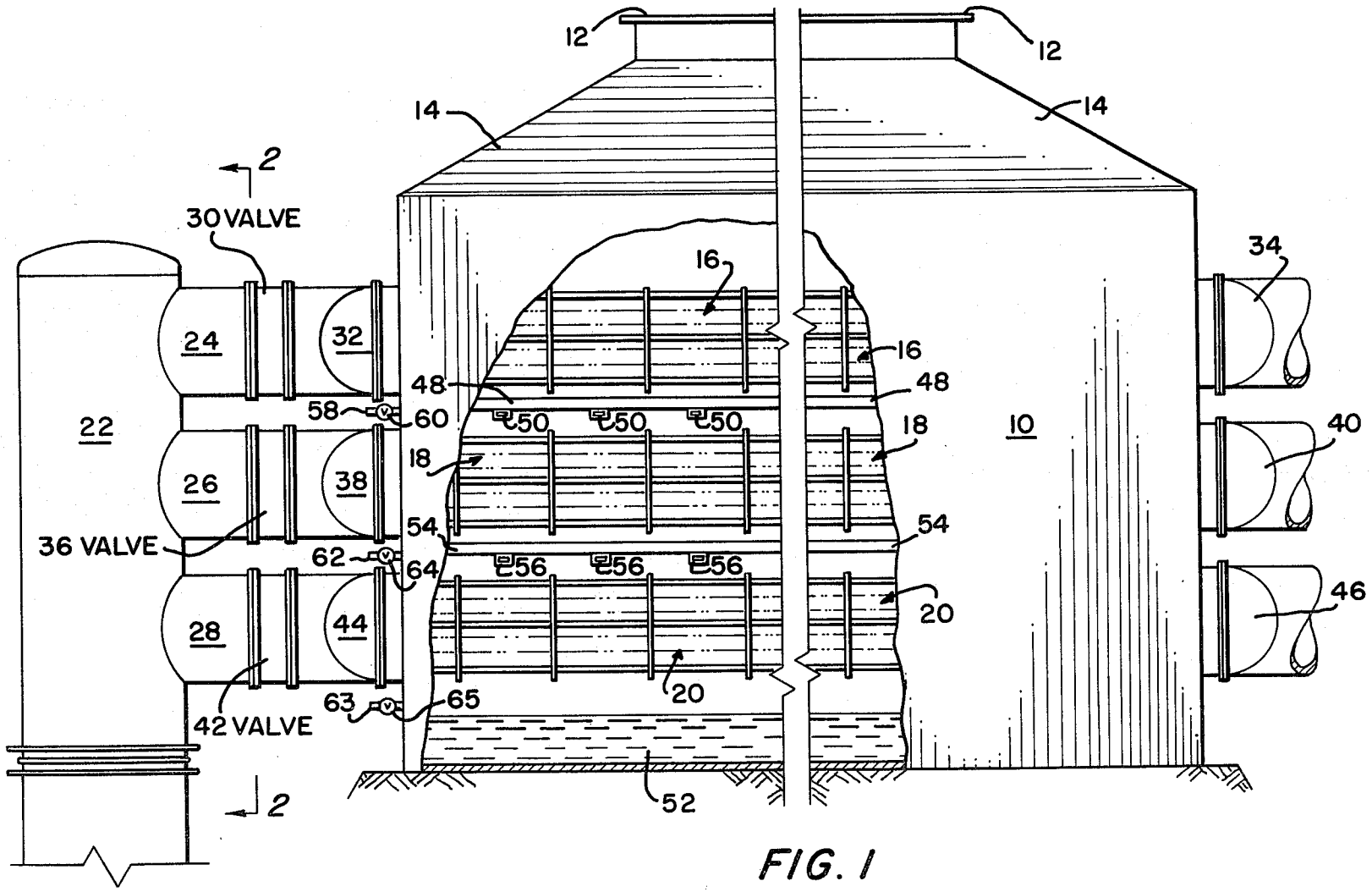
FIG. 1 is a side elevation of a steam condensing system in accordance with this invention, with portions broken away to show the interior of the condenser.
Figure 2:
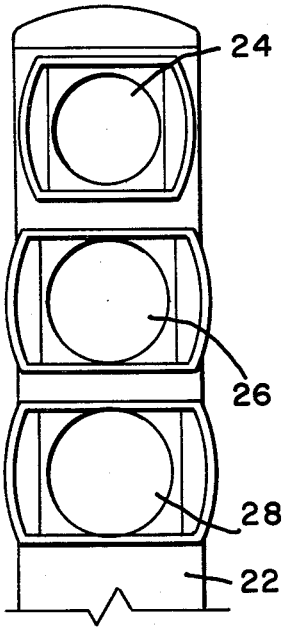
FIG. 2 is a view taken along lines 2--2 of FIG. 1 and in the direction of the arrows.
Figure 3:
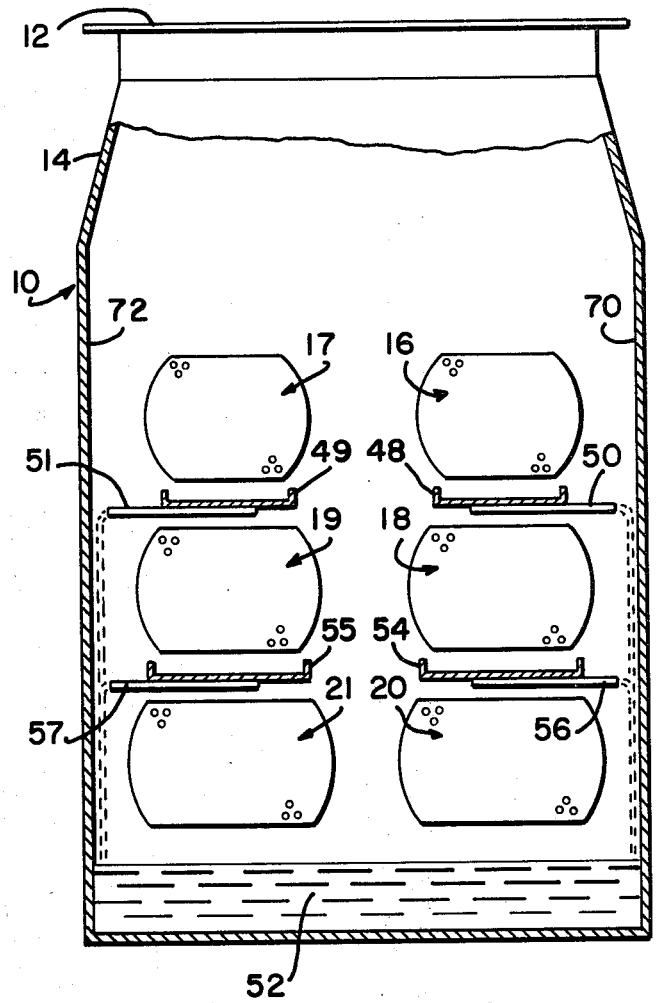
FIG. 3 is a transverse sectional view through the interior of the condensor of FIG. 1.

Referring to the drawings, and more particularly to FIG. 1 and FIG. 3, our new system for condensing a gas such as steam includes a housing 10 with a gas inlet such as steam inlet 12 at the top of the housing 10. The steam enters the housing 10 at the gas inlet 12, flows through the dome 14, and then into the main body of housing 10 over two horizontally separated columns of vertically separated longitudinally extending tube bundles. One column comprises tube bundles 16, 18 and 20; the other column comprises tube bundles 17, 19 and 21 (see FIG. 3).

Water is fed to the tubes in each of the tube bundles 16, 18 and 20 by means of a stand pipe 22 and vertically spaced water conduits 24, 26 and 28. Water from stand pipe 22 flows through conduit 24 controlled by valve 30 through water box 32, through the tubes in tube bundle 16, and then out from the housing through water outlet 34. Similarly, water flows from the stand pipe 22 through water conduit 26 controlled by valve 36 through water box 38, through the tubes in tube bundle 18 and out of the housing 10 through water outlet 40. Also, similarly, water from stand pipe 22 flows through water conduit 28 controlled by valve 42 through water box 44, through the tubes in tube bundle 20, and then out of the housing 10 through water outlet 46. A separate stand pipe (not shown) with separately valve controlled conduits (not shown) and water outlets (not shown) are connected to tube bundles 17, 19 and 21. The water outlets 34, 40 and 46 may lead to a second surface condenser of similar structure to the structure shown in FIG. 1. Any other number of surface condensers may be arranged with series or parallel water circuits.

Steam entering the housing 10 passes over the tube bundles and is condensed by the cold water flowing through the tubes in these tube bundles. The condensate from tube bundle 16 flows into the longitudinal tray 48 and then through the longitudinally separated condensate conduits 50 into the hot well 52. Similarly, the condensate from tube bundle 18 flows into the longitudinal tray 54 and then through water conduits 56 into the hot well 52. The condensate from tube bundle 20 falls directly into the hot well 52.

The condensate from tube bundle 17 and the condensate from tube bundle 19 is collected by trays 49 and 55, respectively, and flowed into hot well 52 through conduits 51 and 57, respectively. The condensate from tube bundle 21 flows directly into the hot well 52.

A separate means for detecting contamination is provided for each of the tube bundles. Any suitable detecting system may be used such as the detecting system shown in U.S. Pat. No. 3,057,602 issued to R. J. Stoker et al on Oct. 9, 1962. If contamination is detected, for example in the tray 48, the contaminated condensate may be removed through condensate outlet 58 controlled by valve 60 (see FIG. 1). Similarly, any contaminate in tray 54 may be removed through conduit 62 controlled by valve 64. Any contaminated condensate from the end of tube bundle 20 may be removed through conduit 63, controlled by valve 65.

Figure 4:
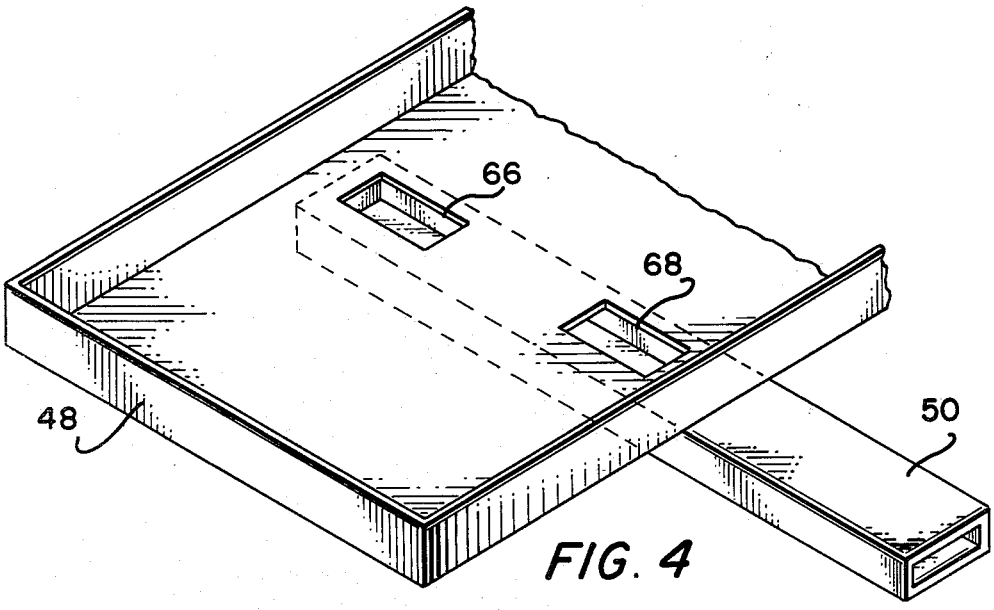
FIG. 4 is a perspective view, on an enlarged scale, showing the tray and condensate removal system of this new condenser.

The condensate from tray 48 flows through transversely separated rectangular holes 66 and 68 (see FIG. 4) in the bottom of the tray 48; and then through conduits 50 toward the longitudinal side wall 70 of the housing 10. Transversely separated holes similar to the holes 66 and 68 in tray 48, are also provided in all of the other trays in the system. The condensate from tray 54 flows through conduits 56 toward longitudinal side wall 70 of the housing. The condensate from trays 49 and 55 flows through conduits 51 and 57 extending from trays 49 and 55, respectively, and toward the longitudinal side wall 72 of housing 10.

By flowing all condensate out toward the side walls 70 and 72 of the housing, the condensate is kept from being swept against the tubes in the tube bundles thus preventing errosion of the tubes.

Each of the tube bundles in a particular vertical column of tube bundles has a different gas condensing capacity. In the preferred embodiment shown the different condensing capacities are provided by tube bundles of different cross section with the smallest cross section in the top tube bundle and the largest cross section in the bottom tube bundle. The different widths of the tube bundles with the smallest width being the width of the top tube bundles and the intermediate width being the width of the middle tube bundles and the largest width being the width of the bottom tube bundles provides a larger space between the outside edge of the top tube bundle and the nearer longitudinal wall, with the next largest space being between the outside edge of the middle tube bundles and the nearer longitudinal wall; and the smallest space being the space between the outside edge of the bottom tube bundle and the nearer longitudinal wall.

The horizontal space separating tube bundles 16 and 17 is larger than the horizontal space separating tube bundles 18 and 19, which in turn is larger than the horizontal space separating tube bundles 20 and 21.

As the steam entering steam inlet 12 flows over the uppermost tube bundle in each column, a certain amount of steam is condensed by that tube bundle. Therefore, less steam flows between the nearer longitudinal side walls and the outside edges of tube bundles 18 and 19 then flows between the nearer longitudinal side walls and the outside edges of the top tube bundles 16 and 17. Since some of the steam flowing over tube bundles 18 and 19 is condensed, there is less steam flowing between the outside edges of tube bundles 20 and 21 and the nearer longitudinal wall. This construction provides for a more uniform steam flow velocity around the tube bundles.

We claim:

1. A system for condensing a gas comprising a housing having a gas inlet into the top wall of the housing, at least one vertical column of vertically spaced separate tube bundles, said tube bundles being separated from the longitudinal walls of the housing defining gaps between the longitudinal walls and the sides of the tube bundles so that gas entering through said inlet will flow through the gaps as well as into the space between the tube bundles, a separate valved water conduit connected to each tube bundle, a condensation collection tray located beneath each tube bundle which is above the lowermost tube bundle, conduit means at least partially disposed in one of said gaps for flowing condensate from each tray into the bottom of the housing by way of said one gap, a condensate collection means below the lowermost tube bundle for receiving condensate from each tray, and the separate tube bundles being vertically aligned with the width of the tube bundles being progressively larger from the top tube bundle to the lowermost tube bundle whereby the gas condensing capacity of said bundles increases and said gaps progressively decrease from the top tube bundle to the lowermost tube bundle.

2. A system in accordance with claim 1 wherein each tray is horizontally disposed, said conduit means including a plurality of horizontally disposed conduits, each tray communicating with one end of one of said horizontally disposed conduits, the other end of each conduit terminating in said one gap for discharge of condensate through said one gap to said condensate collection means.

3. A system in accordance with claim 1 wherein two such vertical columns of tube bundles are disposed side by side within said housing and similarly spaced from the side walls of said housing, said columns being spaced from one another so as to define a downwardly extending space which progressively decreases from top to bottom whereby gas entering from said inlet will flow between the tube bundles of said columns, and a dome on said housing between said inlet and the portion of the housing containing said columns, the transverse dimensions of said dome progressively increase in a direction from said inlet towards said columns.

4. A system in accordance with claim 1 wherein there are at least three tube bundles in said vertical column.

5. A system in accordance with claim 1 including a discrete valved conduit extending through a wall of said housing and communicating with each tray for selective removal of condensate from the trays.

* * * * *